US006422914B1

(12) United States Patent
Nelson et al.

(10) Patent No.: US 6,422,914 B1
(45) Date of Patent: Jul. 23, 2002

(54) DUAL-FUNCTION BALLOON WEIGHT

(76) Inventors: David C. Nelson, 2727 N. Revere Rd., Akron, OH (US) 44333; John J. Andrisin, 613 Center Ave., Cuyahoga Falls, OH (US) 44221

( * ) Notice: Subject to any disclaimer, the term of this patent is extended or adjusted under 35 U.S.C. 154(b) by 0 days.

(21) Appl. No.: 09/751,637

(22) Filed: Dec. 29, 2000

(51) Int. Cl.[7] ..... A63H 3/06
(52) U.S. Cl. ..... 446/220; 248/346.03
(58) Field of Search ..... 446/220, 221, 446/222, 223, 224, 225, 226; 248/346.03

(56) References Cited

U.S. PATENT DOCUMENTS 3,639,949 A * 2/1972 Beck ..... 24/49
5,035,391 A * 7/1991 Steele et al. ..... 446/220
5,074,510 A * 12/1991 Metz ..... 446/220
6,050,024 A * 4/2000 Manno ..... 43/81

* cited by examiner

*Primary Examiner*—Derris H. Banks
*Assistant Examiner*—Urszula M Cegielnik
(74) *Attorney, Agent, or Firm*—Renner, Kenner, Greive, Bobak, Taylor & Weber

(57) ABSTRACT

A dual-function balloon weight is provided having a base member that provides first and second attachment points for securing balloons to the base member. A first attachment point is provided at one position on the base member for tying individual balloons to the base member at this first position. The second attachment point is provided at a second position on the base member for securing a multitude of balloons thereto to provide a balloon bouquet. At the second attachment point, a multitude of balloons can be secured to a retention member that couples with the base member of the balloon weight. Thus, the balloon weight of the present invention is a dual-function balloon weight in that individual balloons may be secured thereto as with common balloon weights and, additionally or alternatively, a multitude of balloons can be attached thereto to provide a balloon bouquet.

7 Claims, 1 Drawing Sheet

DUAL-FUNCTION BALLOON WEIGHT

TECHNICAL FIELD

The invention herein resides in the art of balloon devices and accessories. More particularly, the invention relates to a balloon weight having multiple attachment points to tether an inflated balloon or balloons thereto in order to restrain the balloons. Specifically, the invention relates to a balloon weight having at least one attachment point to which balloons may be tied and at least one attachment point to which a bouquet of balloons may be attached to create a decorative balloon display.

BACKGROUND ART

Helium balloons are commonly used as decorations at parties, celebrations, and other special events. Generally, such decorative balloons are attached to stationary objects at the celebration so that they will be restrained from floating away. Particularly, helium balloons are oftentimes tied to chairs, table legs, posts, and other fixtures, as well as more mobile objects such as plant displays and small sandbags such that they are restrained from floating away and yet can be readily moved before, during, or after the festivities.

Thus, it is known to employ a weight at the end of a ribbon tethered to a balloon in order to restrain the balloon from free flight. Many of these weights are distinctively shaped to provide an ornamental display for the balloon affixed thereto. The weight is placed in a vertical position to fully display its decorative shape and the balloon extends therefrom so as to be displayed and yet restrained from free flight. Most often, it is necessary to cut a length of ribbon and physically tie one end of it to the weight and knot or otherwise attach the opposite end to the balloon in order to properly restrain the balloon. This operation can be quite time consuming.

Additionally, "balloon bouquets," which should be understood as an arrangement of multiple helium balloons tied to a stationary object so as to be held in close proximity to each other, are becoming more and more popular for use as decorations. Balloon bouquets are created by separately tying the ribbons associated with each individual balloon of the bouquet to the same weighted object. Notably, no specific weight device has been provided in the prior art for this purpose, although the creation of the balloon bouquets can be extremely time consuming. Thus, there exists a need in the art for a balloon weight that can quickly and easily retain a multitude of balloons to provide a balloon bouquet.

It should also be appreciated that balloon weights are not only used because they function to restrain a balloon from free flight, but they are also used because of their aesthetic appeal and for the simple reason that they can serve as a grip for someone wanting to carry a helium balloon or balloons attached thereto. Thus, it is desirable to provide a balloon weight that is aesthetically pleasing and that can be used as a basic balloon weight as well as a weight for a balloon bouquet. Thus, there exists a need in the art for a dual function balloon weight that may serve as a common balloon weight and a balloon bouquet weight.

OBJECTS OF THE INVENTION

In light of the foregoing, it is an object of the present invention to provide a balloon weight that can retain multiple balloons.

It is another object of the present invention to provide a balloon weight, as above, that can serve as a base from which a balloon bouquet extends.

It is another object of the present invention to provide a balloon weight, as above, wherein the balloon weight can also function as a common balloon weight wherein balloons are physically tied thereto.

It is still another object of the present invention to provide a balloon weight, as above, wherein the balloon weight is sufficiently weighted so as to be able to restrain multiple balloons from free flight.

These and other objects of the present invention which will become apparent from the description that follows are achieved by a balloon weight having a base member with a first attachment point where at least one balloon can be secured to the base member and a second attachment point where at least one balloon can be secured to the base member. In one embodiment, the second attachment point includes a removable retention member that removably couples with the base member such that a multitude of ribbons associated with a multitude of respective balloons may be first tied to the retention member and then subsequently attached to the base member by connecting the retention member thereto in order to secure the balloons to the balloon weight without the need for tying each individual ribbon directly to the base member.

Other objects of the present invention are achieved by a balloon weight having a base member, a loop provided at one position on the base member where at least one balloon may be secured to the base member by tying a ribbon associated with the balloon to the loop, and a retention bar removably secured to the base member at a second position by a frictional engagement with the base member such that individual balloons may first be secured to the retention bar and then subsequently attached to the base member by connecting the retention member thereto in order to secure the balloons to the balloon weight without the need for tying each individual ribbon directly to the base member. Advantageously, the loop provided on the base member may allow the weight to be displayed in a vertical fashion by hanging the weight by the loop for display purposes.

DESCRIPTION OF THE DRAWINGS

For a complete understanding of the objects, structure, and utility of the invention, reference should be made to the following detailed description and accompanying drawings wherein.

BEST MODE FOR CARRYING OUT THE INVENTION

Figure 1:
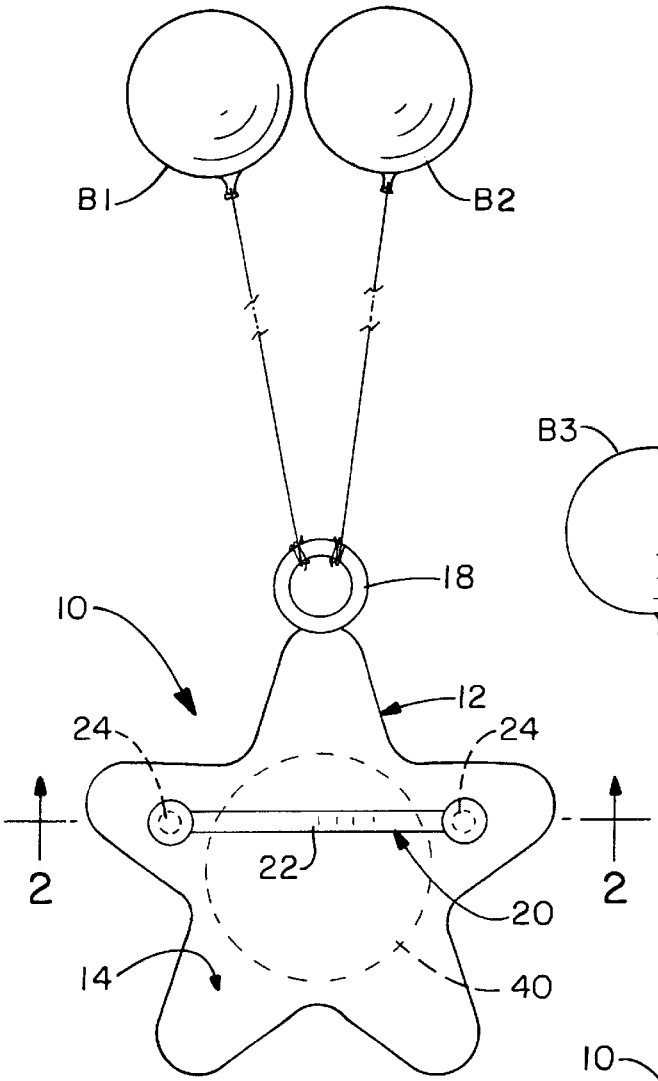
FIG. 1 is a front plan view of the balloon weight according to the present invention.

With reference to the drawings herein, it can be seen that the balloon weight of the present invention is designated generally by the numeral 10. Balloon weight 10 includes a base member 12 having a top surface 14 and a bottom surface 16. Base member 12 is represented in FIG. 1 as being star-shaped simply to illustrate the point that it is desirable that balloon weights be aesthetically pleasing; however, base member 12 can be any desired shape.

Base member 12 is provided with a first attachment point 18 for securing balloons thereto. In FIG. 1, first attachment 18 is shown as being a loop to which a balloon or balloons B1, B2 (not drawn to scale) may be tied. Thus, balloon weight 10 can be employed as a common balloon weight wherein balloons are simply tied to an attachment point 18 and base member 12 serves as either a weight for the balloon or balloons or a grip for carrying the balloon or balloons. Of course, it should be appreciated that first attachment point 18 is represented as a loop merely to disclose the preferred mode for practicing the present invention, and the present invention should not be limited thereto or thereby, it being understood that the first attachment point 18 may take various forms as, for example, a simple hole on base member 12 to which the ribbons are tied, or a hole with an associated male plug for frictionally securing ribbons having ends inserted into the hole.

Figure 2:
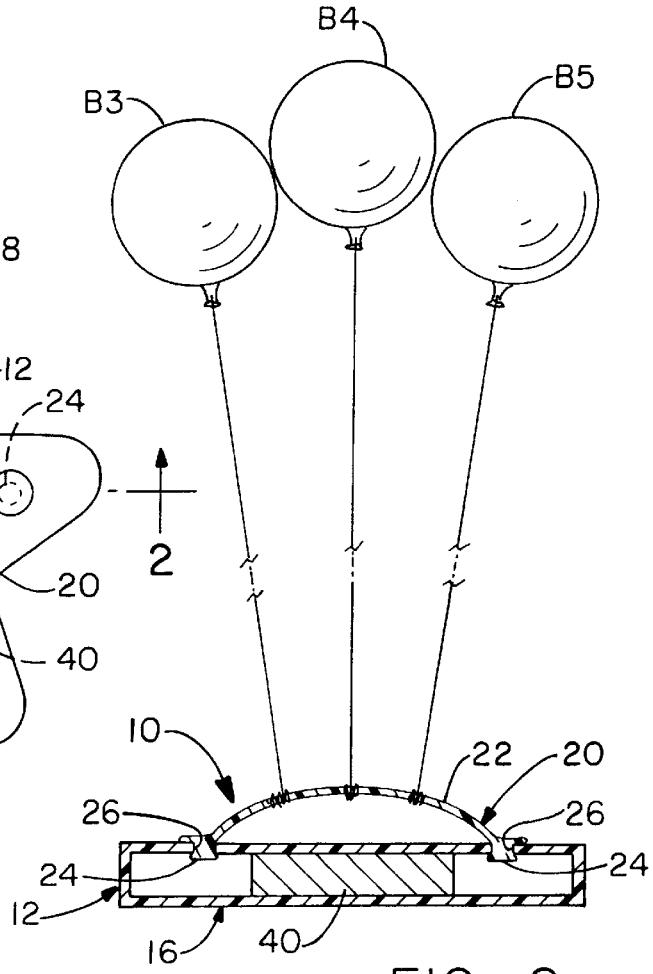
FIG. 2 is a cross sectional view of the balloon weight according to the present invention taken along the line 2—2 of FIG. 1.

Referring now to FIG. 2, it can be seen that top surface 14 of base member 12 provides second attachment point 20 to which a multitude of balloons, represented as balloons B3, B4, and B5 (not drawn to scale), may be attached to provide a balloon bouquet. Second attachment point 20 includes a retention bar 22 having at least one plug 24. It should be noted that, in FIG. 2, retention bar 22 is shown as having two plugs 24, one extending from each end of retention bar 22; however the present invention should not be limited thereto or thereby, the important consideration being that retention bar 22 selectively engages base member 12 to hold balloons as hereinafter described.

Plugs 24 are removably received within a corresponding hole 26 provided on top surface 14 of base member 12 such that a multitude of balloons, as represented at B3, B4, and B5, may be easily attached to balloon weight 10 simply by tying the balloon ribbons to retention bar 22 either before or after plugs 24 are mated with corresponding holes 26. Plugs 24 and holes 26 are sized such that they mate through a press or friction fit having a tight tolerance that resists accidental disjoining of second attachment point 20 from base member 12. In this manner, the ribbons to a multitude of balloons B3, B4, and B5 can be tied to retention bar 22 and frictionally secured to base member 12. Thus, a multitude of balloons can be attached at second attachment point 20 to provide a balloon bouquet having a decorative base member that will increase the overall aesthetic appeal of the bouquet. Although not shown in the Figures provided, it should also be appreciated that one benefit provided by a second attachment point 20 such as retention bar 22 is that each individual balloon (e.g. B3, B4, and B5) need not be separately tied to attachment point 20. Rather, ribbons from a multitude of balloons may be overlaid and then tied to attachment point 20 with one knot.

Preferably, as shown in FIG. 2, retention bar 22 is flexible and is deliberately constructed to provide a distance between plugs 24 that is greater than the distance between holes 26 such that, when plugs 24 are mated with holes 26, a substantial gap between retention bar 22 and top surface 14 of base member 12 is provided in order to make it very easy to attach balloon ribbons to retention bar 22 when retention bar 22 is already secured to base member 12. Additionally, retention bar 22 is preferably of sufficient length to pass the no-choke test for child safety.

Inasmuch as it is conceived that balloons may be attached to retention bar 22 before retention bar 22 is frictionally coupled to holes 26, it is merely preferred, and not necessary, that retention bar 22 provide the substantial gap mentioned hereinabove. Additionally, it should be appreciated that retention bar 22, when providing a substantial gap as shown in FIG. 2, need not be removable from base 12 because balloons such as B3, B4, and B5 could readily be secured to such a retention bar 22 without the need for removal of retention bar 22 from its attachment with base 12. However, as stated above, it is preferred that retention bar 22 selectively engage base 12 such that retention bar 22 can be removed from base 12 in order to facilitate the operation of securing balloons to retention bar 22. Indeed, the present invention should not be limited to any particular structure or design of second attachment point 20 so long as second attachment point 20 provides a means for providing a balloon bouquet.

Figure 3:
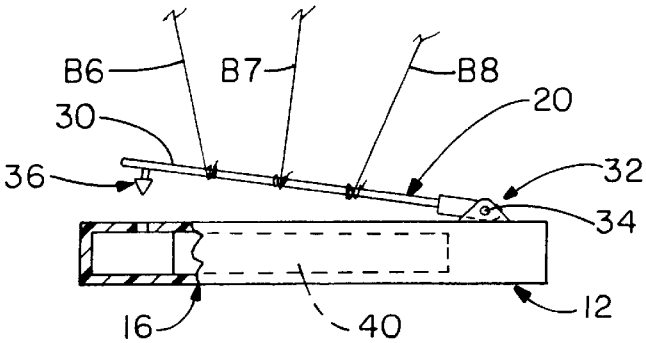
FIG. 3 is a cross sectional view as in FIG. 2 but showing an alternative embodiment of the balloon weight according to the present invention.

As mentioned hereinabove with respect to first attachment point 18, it should be understood that the particular embodiment of second attachment point 20 disclosed herein, having a retention bar 22 with plugs 24 that frictionally engage holes 26, is merely a preferred embodiment, and the present invention should not be limited thereto or thereby. The important function of second attachment point 20 is that a multitude of balloons may be attached to balloon weight 10 to provide a balloon bouquet. Therefore, it should be readily understood that the second attachment point 20 could take many structural forms and yet fall within the scope of the present invention. For instance, with reference to FIG. 3, it can be seen that second attachment point 20 could be provided as a retention bar 30 that is pivotally connected to base member 12 at fulcrum 32 by pin 34 and may be rotated and locked in a position wherein a multitude of ribbons associated with balloons $B_6$, $B_7$, and $B_8$ are tied to retention bar 30 so as to provide a balloon bouquet. In this alternative embodiment, retention bar 30 can be locked in its balloon-retaining position by any suitable clamp, as represented generally in FIG. 3 at numeral 36.

When used as a weight for a balloon bouquet, balloon weight 10 must be of sufficient weight such that balloon weight 10 will remain where it is placed without being influenced by the forces acting upon it through the multitude of helium balloons attached thereto. Therefore, base member 12 is preferably sized or constructed to weigh at least about four ounces (4 oz.). Of course, the requisite weight of base member 12 will depend upon the number of balloons to be attached to balloon weight 10 and, therefore, the present invention should not be limited to any particular weight or weight range. In a preferred embodiment, base member 12 is constructed of inexpensive, light weight plastic, such as polypropylene or polyethylene, but includes a weight insert 40 enclosed therein to add sufficient mass to the base member 12 to ensure that even a multitude of balloons attached to balloon weight 10 will not compromise the stationary placing of balloon weight 10.

Thus it can be seen that the objects of the invention have been satisfied by the structure presented above. While in accordance with the patent statutes only the best mode and preferred embodiment of the invention has been presented and described in detail, the invention is not limited thereto or thereby. Accordingly, for an appreciation of the true scope and breadth of the invention reference should be made to the following claims.

What is claimed is:

1. A balloon weight, comprising:

a base member;

a first attachment point for securing at least one balloon to said base member; and a second attachment point for securing at least one balloon to said base member, said second attachment point including a retention bar having at least one plug for selectively coupling with a corresponding at least one hole in said base member such that a ribbon associated with a balloon may be tied to said retention bar and then said retention bar can be subsequently coupled with said base member in order to secure the balloon to the balloon weight.

2. The balloon weight according to claim 1, wherein said first attachment point is a loop provided on said base member for tying balloon ribbons thereto.

3. The balloon weight according to claim 1, further comprising a weight insert retained by said base member.

4. A balloon weight according to claim 1, wherein said base member includes first and second holes and said retention bar includes a first plug proximate one end of said retention bar and a second plug proximate an opposite end of said retention bar, said first plug selectively coupling with said first hole and said second plug selectively coupling with said second hole.

5. A balloon weight according to claim 4, wherein said retention bar is of sufficient length such that, when said first plug is coupled with said first hole and said second plug is coupled with said second hole, a gap is provided between said retention bar and said base member.

6. The balloon weight comprising:

a base member including a first attachment point for securing at least one balloon to said base member; and a second attachment point for securing at least one balloon to said base member, said second attachment point including a retention bar that is pivotally connected to said base member proximate one end of said retention bar, said base member including a clamp proximate the opposite end of said retention bar such that said retention bar may pivot to connect to said base member through said clamp.

7. A balloon weight, comprising:

a base member including at least one hole at a first position;

a loop on said base member for securing at least one balloon to said base member at a second position by tying a ribbon associated with a balloon to said loop;

a retention bar including at least one plug for coupling with said at least one hole by a press fit to removably secure said retention bar to said base member at said first position by a frictional engagement with said base member such that, when said retention bar is secured to said base member, said retention bar is capable of securing at least one balloon to said base member at said second position.

* * * * *